US009518549B2

(12) United States Patent
Weinum et al.

(10) Patent No.: US 9,518,549 B2
(45) Date of Patent: Dec. 13, 2016

(54) METHOD AND DEVICE FOR OPERATING A STARTER OF A VEHICLE

(75) Inventors: Matthieu Weinum, Stuttgart (DE); Marc Eschenhagen, Ludwigsburg (DE); Benjamin Jensen, Groβbottwar (DE); Andreas Jesse, Freudental (DE); Michael Merkle, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 1386 days.

(21) Appl. No.: 13/304,831

(22) Filed: Nov. 28, 2011

(65) Prior Publication Data

US 2012/0139263 A1 Jun. 7, 2012

(30) Foreign Application Priority Data

Dec. 1, 2010 (DE) ..... 10 2010 062 241

(51) Int. Cl.

| | |
|---|---|
| ***F02N 11/00*** | (2006.01) |
| ***F02N 15/06*** | (2006.01) |
| ***F02N 11/08*** | (2006.01) |

(52) U.S. Cl.

CPC ..... *F02N 15/06* (2013.01); *F02N 11/0851* (2013.01); *F02N 2200/047* (2013.01); *F02N 2200/048* (2013.01)

(58) Field of Classification Search

CPC F02N 11/0851; F02N 15/06; F02N 2200/047; F02N 2200/048

See application file for complete search history.

(56) References Cited

U.S. PATENT DOCUMENTS

| | | | | |
|---|---|---|---|---|
| 4,717,874 | A * | 1/1988 | Ichikawa et al. | 324/207.16 |
| 4,723,446 | A * | 2/1988 | Saito et al. | 73/313 |
| 4,774,915 | A | 10/1988 | Nguyen et al. | |
| 5,383,428 | A * | 1/1995 | Fasola | F02N 11/08 123/179.3 |
| 5,970,937 | A * | 10/1999 | Casellato | F02N 11/0851 123/179.3 |
| 2010/0282199 | A1* | 11/2010 | Heyers et al. | 123/179.3 |
| 2011/0202264 | A1* | 8/2011 | Sengebusch | F02N 11/0851 701/113 |
| 2012/0191329 | A1* | 7/2012 | Roessle | F02N 11/0855 701/113 |

FOREIGN PATENT DOCUMENTS

| | | | |
|---|---|---|---|
| CN | 1320193 | A | 10/2001 |
| CN | 1502798 | A | 6/2004 |
| CN | 1573085 | A | 2/2005 |
| CN | 1821569 | A | 8/2006 |
| CN | 101432519 | A | 5/2009 |
| EP | 0 844 388 | | 5/1998 |
| EP | 1 041 275 | * | 10/2000 |
| FR | 2 958 393 | * | 10/2011 |
| JP | 2004-100502 | * | 4/2004 |
| WO | WO 2010/015450 | * | 2/2010 |
| WO | WO 2011/018340 | * | 2/2011 |

* cited by examiner

*Primary Examiner* — William C Joyce

(74) *Attorney, Agent, or Firm* — Norton Rose Fulbright US LLP; Gerard Messina

(57) ABSTRACT

In a method for operating a starter of a vehicle, a position of a starter pinion is detected, and an advance of the starter pinion is regulated as a function of the detected position. For example, the advance during the meshing of the starter pinion with a starter ring gear of a drive motor of the vehicle is regulated.

11 Claims, 10 Drawing Sheets

METHOD AND DEVICE FOR OPERATING A STARTER OF A VEHICLE

BACKGROUND OF THE INVENTION

1. Field of the Invention

The present invention relates to a method and device for operating a starter of a motor vehicle.

2. Description of the Related Art

As a rule, familiar pinion-based starter systems are designed in such a way that they follow a sequence control. Intermediate states, such as the striking of a tooth of a starter pinion on a tooth of a starter ring gear during meshing of the starter pinion with the starter ring gear, are bridged via spring travels, so that an electric relay contact in a solenoid-operated switch of the starter is able to be closed, even though the pinion is not yet engaged with a ring gear, i.e., the starter ring gear of an engine flywheel. An electric motor of the starter system already starts up in this state, and the gear wheels mesh due to the rotary motion.

Because of its mechanical impacts on the teeth and at the limit stop, this process is prone to bring about wear and causes noise emissions. Especially in the case of vehicles having a start/stop function, this leads to negative comfort characteristics of the vehicle when starting the engine. Furthermore, the starter system must be constructed more sturdily in order to ensure cycle life with respect to starting, especially for vehicles having a start/stop function. This leads to increased costs and considerable manufacturing expenditure.

BRIEF SUMMARY OF THE INVENTION

An object of the present invention is to provide a method and a device which overcome the known disadvantages, and which exhibit reduced noise emission when starting the vehicle.

According to one aspect, a method is provided for operating a starter of a vehicle. A position of a starter pinion is detected, and an advance of the starter pinion is regulated as a function of the detected position.

According to a further aspect, a device is provided for operating a starter of a vehicle. The device has a sensor for detecting a position of a starter pinion. The device also has an advance control for regulating an advance of the starter pinion as a function of the detected position.

Thus, the position of the starter pinion is detected, especially relative to a starter ring gear. An advance of the starter pinion in the direction of the starter ring gear may be controlled to the extent that a hard collision of the teeth of the respective gears is avoided. Thus, a low-noise meshing is advantageously attained. Possible impacts may be recognized and/or reduced. Preferably, the advance is regulated via power electronics, in particular, a force built up by the advance is regulated.

According to one specific embodiment, a speed of the starter pinion is detected, the advance of the starter pinion being regulated as a function of the detected speed. For instance, a constant advance speed may be set. In particular, a time characteristic of the speed may be ascertained. Preferably, the time characteristic of the speed is integrated, so that the position of the starter pinion may be calculated based on the integral of the speed.

According to another specific embodiment, the ascertainment of the position of the starter pinion includes ascertainment of an induction change in response to the advance of the starter pinion. Measuring a change in induction offers the special advantage that it may be carried out in particularly sensitive fashion—for example, filtering to the measuring signal is easily possible from the standpoint of circuit engineering—and that the corresponding measuring signal may be made available to a control algorithm for calculating an advance speed.

In another specific embodiment, the advance during the engagement of the starter pinion with the starter ring gear of a drive motor of the vehicle is regulated. In particular, the control during a meshing process offers the advantage that possible impacts may be recognized in this critical phase, and to that extent, may be avoided or reduced.

According to a further specific embodiment, the starter pinion is rotated during the meshing, in order to feel into a space between two teeth of the starter ring gear. Preferably, the starter pinion is rotated pulse-by-pulse. The teeth of the starter pinion thus feel into the corresponding spaces of the starter ring gear. This process of feeling into the spaces advantageously reduces a mechanical impact of the gear wheels. In particular, in so doing, a starter motor which is coupled to the starter pinion is rotated, especially, is rotated slowly. Preferably, the starter motor is driven accordingly by power electronics.

According to one specific embodiment, shortly before the starter pinion reaches a limit stop, thus, shortly before the starter pinion is meshed with the starter ring gear, the advance of the starter pinion is reduced, so that advantageously, the limit stop is not reached with full force.

In another specific embodiment, upon detecting contact of a starter pinion tooth with a tooth of the starter ring gear, the starter pinion is moved in a direction counter to that of the advance, in order to create a distance between the starter pinion tooth and the tooth of the starter ring gear. Instead of the starter pinion being moved further forward against resistance, it is moved back somewhat, thus advantageously avoiding damage to the starter pinion. For example, after the distance has been created, the starter pinion is rotated and moved in the direction of the starter ring gear, in order to mesh with the starter ring gear. Thus, a new meshing attempt is carried out, this time, in comparison to the previous meshing attempt, the starter pinion being rotated, so that there is a possibility that in this meshing attempt, the starter pinion tooth may be moved into a tooth space in the starter ring gear. In particular, this process may be repeated until the starter pinion has meshed with the starter ring gear.

According to one specific embodiment, the device has a coil assemblage or coil pack in order to build up a magnetic flux for an inductive advance of the starter pinion. An inductive advance offers the special advantage that mechanical friction is reduced during the advance, which means a corresponding wear is decreased. The coil assemblage preferably includes two coils, which may also be denoted as primary coil and secondary coil. Both the primary coil and the secondary coil may also be denoted as actuator coils.

According to a further specific embodiment, the sensor has a sensor coil, disposed in the coil assemblage, for detecting an induction change in response to the advance of the starter pinion. Preferably, the sensor coil is integrated into the primary coil and/or into the secondary coil. In particular, the primary coil and/or the secondary coil is/are also formed as a sensor coil. Particularly when ascertaining the induction change, an induced voltage is measured that results especially from the movement of the starter pinion and from a change in current in the coil assemblage. The measured induced voltage is preferably filtered out of the movement and made available to a control algorithm as a sensor signal for the speed of the starter pinion. Thus, in advantageous manner, a coil current may be set, especially with the aid of power electronics, in such a way that a constant or regulated rate of advance of the starter pinion is achieved. In another specific embodiment, the sensor coil may also be formed separately from the primary coil and the secondary coil, thus, the two actuator coils. The sensor coil is preferably formed separately from the coil assemblage. That means, in particular, that the sensor coil is not used as actuator coil, and so far as that goes, is also not actively energized in these cases. Nevertheless, in a further specific embodiment, in spite of the formation of the sensor coil separate from the actuator coils or the coil assemblage, the sensor coil may also be used as a further actuator coil, and particularly in this case, is actively energized, that is, receives an electrical current.

In another specific embodiment, the coil assemblage has a sliding bushing for the displacement of an armature coupled to the starter pinion. The sliding bushing preferably has at least one magnetizable ring to influence the magnetic flux. Thus, especially in an advantageous manner, the controlled system behavior is linearized in terms of the advance. Preferably, a plurality of rings is provided. The ring or rings is/are preferably made of steel. In particular, the at least one magnetizable ring is disposed displaceably or fixedly in the sliding bushing. Preferably, a few rings may be disposed displaceably, and a few further rings may be disposed fixedly in the sliding bushing. According to a further specific embodiment, the rings have an identical or different diameter. The ring is preferably formed integrally with the sliding bushing. That is to say, the ring is a part of the sliding bushing. According to another specific embodiment, the ring is formed as a projection in the sliding bushing, across which the armature moves during the axial movement along the sliding bushing. In particular, a sliding bushing may also generally be denoted as a linear friction bearing.

In a further specific embodiment, a spring is provided to retain the starter pinion in a position of rest, the spring being disposed in a drive shaft of the starter. Preferably, the spring may also be situated in the area of the coil assemblage. In particular, the spring is disposed at the starter pinion. In this manner, the spring may advantageously be supported directly on the armature.

Hereinafter, a meshing mechanism denotes a mechanism which brings about a meshing of the starter pinion with the starter ring gear. To that extent, the device of the present invention may also be denoted in particular as a meshing mechanism.

The meshing mechanism is preferably disposed concentrically around the starter pinion, and in this context, preferably the mounting dimensions of starters, especially of known starters, in the vehicle are taken into account. An easy retrofit of known starter systems is thereby permitted in advantageous fashion. In addition, the need for the switching relay, disposed as a "piggyback," together with all transmission elements such as splitter, meshing spring and its suspensions, is advantageously eliminated. The meshing mechanism, i.e., the device may advantageously be integrated in the starter without requiring more space. In particular, the movement of the armature on the meshing magnet may be influenced by the insertion of magnetizable rings, so that different movement profiles result, and in conjunction with the closed-loop control, the meshing process may advantageously be influenced even further.

The essence of the invention includes, in particular, the electronic control and the interaction of the rotary and translatory movement of a starter system, especially of the starter pinion. The one active principle of the present invention—that according to one specific embodiment, a change of an induced voltage in a sensor coil is measured in order to determine a speed and or a position—may also be applied generally to externally mounted mechanisms, externally pertaining especially relative to the starter.

DETAILED DESCRIPTION OF THE INVENTION

Figure 1:
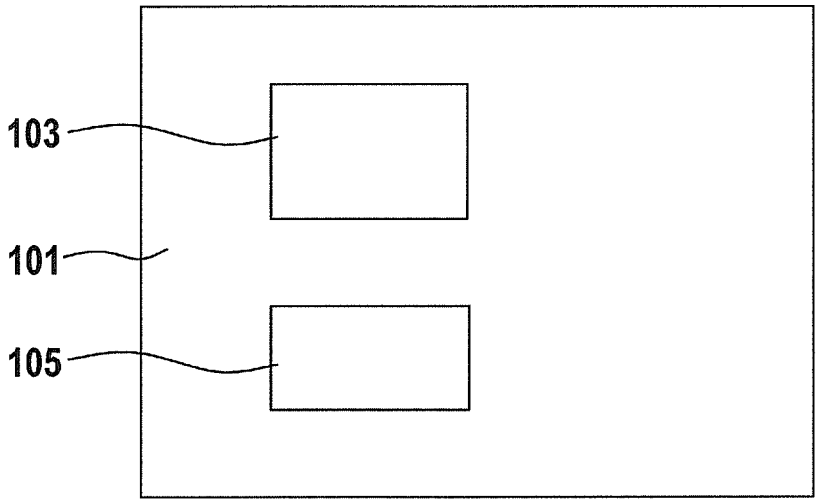
FIG. 1 shows a device for operating a starter of a vehicle.

Hereinafter, identical reference numerals are used for identical features.

FIG. 1 shows a device 101 for operating a starter (not shown) of a vehicle. Device 101 includes a sensor 103. Sensor 103 is furnished to detect a position of a starter pinion (not shown). Device 101 also includes an advance control 105, which is furnished to regulate an advance of the starter pinion, the control being carried out as a function of the detected position of the starter pinion.

Figure 2:
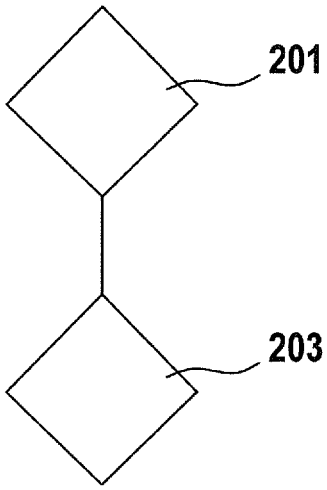
FIG. 2 shows a flowchart of a method for operating a starter of a vehicle.

FIG. 2 shows a flowchart of a method for operating a starter of a vehicle. In a first step 201, a position of a starter pinion is detected. In a step 203, an advance of the starter pinion is regulated as a function of the detected position.

Figure 3A:
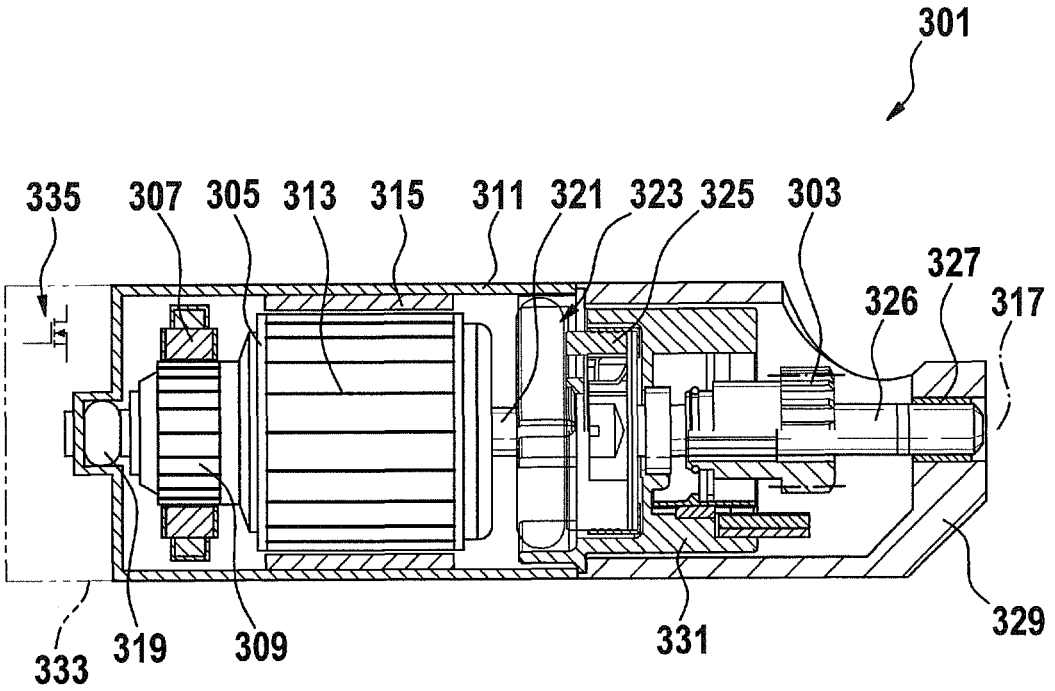
FIG. 3*a* shows a starter with a non-engaged starter pinion.
Figure 3B:
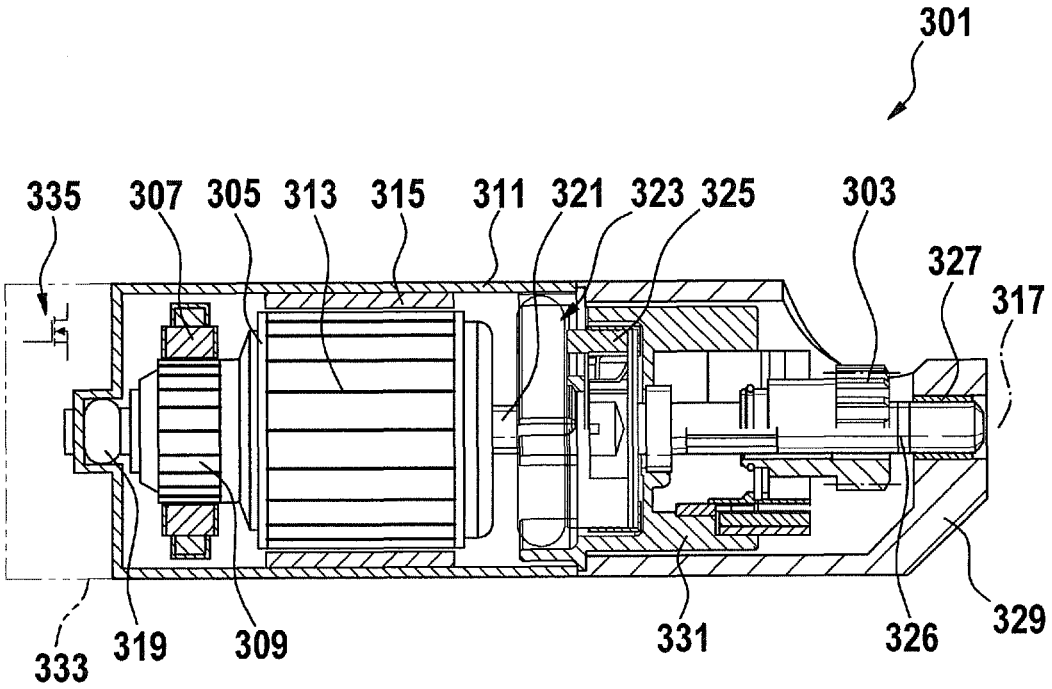
FIG. 3*b* shows the starter from FIG. 3*a* with an engaged starter pinion.

FIG. 3*a* shows a starter 301 having a starter pinion 303 in a non-engaged position. That is to say, starter pinion 303 is not meshed with a starter ring gear (not shown). FIG. 3*b* shows starter 301 from FIG. 3*a*, starter pinion 303 being in an engaged position. That is, starter pinion 303 is meshed with the starter ring gear (not shown).

Starter 301 has an electric motor 305 which has carbon brushes 307 and brushes 309 as current collectors. Electric motor 305 also has a field frame 311. In addition, electric motor 305 includes a rotor 313 having windings. Magnets 315 are formed around rotor 313. A support 319 for an electric-motor shaft 321 is formed in an axis of symmetry 317 of electric motor 305. Electric-motor shaft 321 is coupled to a planetary gear 323, that is coupled to an overrunning clutch 325. In particular, overrunning clutch 325 may be in the form of a roller-type overrunning clutch.

A drive shaft 326 of starter pinion 303 is supported by a friction bearing 327, that is retained by an end shield 329. An intermediate bearing 331 is also formed between overrunning clutch 325 and friction bearing 327. Drive shaft 326 preferably has a splining.

Power electronics, which are represented symbolically by a transistor 335, are mounted in an add-on area 333.

Figure 4:
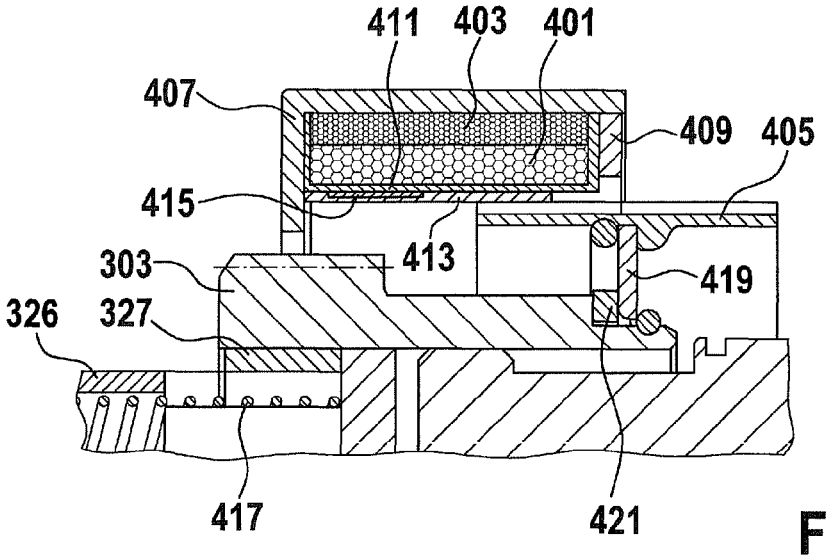
FIG. 4 shows an enlarged view of the starter pinion.

FIG. 4 shows an enlarged view of starter pinion 303.

Starter pinion 303 is moved inductively by a coil assemblage having a primary coil 401 and a secondary coil 403. In so doing, the power electronics energize primary coil 401 and secondary coil 403, a magnetic flux thereby being built up. This magnetic flux gives rise to a mechanical force on an armature 405. Armature 405 is coupled mechanically to starter pinion 303, so that starter pinion 303 is able to move forward and backward along axis of symmetry 317 in accordance with the magnetic flux. Due to this movement, the induction in the magnetic circuit changes, an induced voltage thereby resulting on secondary coil 403. In this respect, secondary coil 403 may also be denoted as a sensor coil. This induced voltage results in particular from the movement, and from the change in current in the two coils 401 and 403. The induced voltage of the movement is filtered out and made available to a control algorithm as a sensor signal for the speed of starter pinion 303. Thus, especially with the aid of the power electronics, a coil current is able to be adjusted or regulated in such a way that a constant or regulated advance speed of starter pinion 303 is obtained. The position of starter pinion 303 may be inferred, as well, preferably based on the integral of the speed. In this manner, possible mechanical impacts may advantageously be recognized and/or reduced. In one specific embodiment not shown, only primary coil 401 is actively energized, that is, receives an electrical current. Secondary coil 403 is thus not used as an actuator coil, and so far as that goes, is not actively energized. An induced voltage, resulting because of the translatory movement of armature 405, on secondary coil 403, which may also be denoted here as a sensor coil, is measured in analogous fashion, so that with the aid of suitable filtering, the speed and the position of armature 405 may be ascertained. When examples having an active energizing of primary coil 401 and of secondary coil 403 are described hereinafter, the intention is for the case with only active energizing of primary coil 401 to always be included, as well. In these cases, secondary coil 403 is not used as an actuator coil, and to that extent, is not actively energized.

The coil assemblage also includes an outer sleeve 407 and a forced-in sleeve disk 409, each of which may preferably be made of magnetizable steel. In this respect, outer sleeve 407 may also be denoted as a magnetic casing. So far as that goes, sleeve disk 409 may also be denoted as a magnetic disk. Sleeve disk 409 and outer sleeve 407 form one sleeve in which sensor coil, i.e., secondary coil 403, and primary coil 401 are disposed on a winding support 411. Winding support 411 may also be denoted as a coil form.

Moreover, at the inner diameter of primary coil 401, a sliding bushing 413 is integrated, in which armature 405 is able to slide during its axial movement. Preferably, sliding bushing 413 may also be disposed in such a way that armature 405 is guided at the inside diameter.

To linearize the controlled system behavior as well as to influence the magnetic flux lines, which may be effected especially by the insertion of magnetizable steel rings 415 into sliding bushing 413, preferably a function may be represented dependent on the advance direction of starter pinion 303, so that the control algorithm of the power electronics may be carried out more easily, i.e., also in controlled fashion, for the standard cases of meshing. In particular, steel rings 415 may be part of sliding bushing 413 and/or be formed as projections which are passed over during the axial movement of armature 405. Moreover, rings 415 may preferably be disposed immovably and/or also in part movably. That is, movably disposed rings 415 also move along during an axial movement of armature 405. In an exemplary embodiment not shown, rings 415 may have a larger, a smaller or perhaps the same diameter in relation to an armature diameter. Preferably all rings 415 have the same diameter. In particular, rings 415 may have different diameters.

Furthermore, a spring 417 is formed which, via an engaging piece 419, is able to retain starter pinion 303 in a defined position of rest when starter 301 is inactive or after the starting procedure. Spring 417 is disposed in drive shaft 326 of starter 301. An open shaft end, which is facing away from the advance direction, is closed with a screw plug (not shown), which means the retention force may be set in advantageous manner. The other spring end is supported via engaging piece 419, which transfers the spring force to starter pinion 303. To that end, drive shaft 326 is open radially owing to a slit (not shown) in the working area, to advantageously ensure a transfer of force and/or an adjusting path.

In particular, given adequate spatial conditions, spring 417 may also be disposed in the area of coils 401 and 403 or preferably on starter pinion 303, and thus also preferably be supported directly on the armature. In this case, in particular, an axial retaining device is implemented accordingly at armature 405, and especially at starter pinion 303, to advantageously permit reliable absorption of the axial forces and accelerations occurring.

In particular, starter pinion 303 and drive shaft 326 have a spur toothing (not shown), since the rotary movements during meshing are realized by electric motor 305 of starter 301. By preference, the toothing may be implemented as splining, especially in widely varying types of construction, which permits a cost-effective possibility for the transfer of torque.

Preferably, starter pinion 303 is connected by an armature disk 419 to armature 405, which initiates the axial movement of starter pinion 303. Armature disk 419 is preferably made of a non-magnetizable material, so that a magnetic shunt via starter pinion 303 is advantageously avoided. For example, armature disk 419 may be made of metal or from one or more non-metals. Preferably, it is made to be strong and wear-resistant, enabling it to handle radial movements.

Armature disk 419 is forced at its outside diameter into armature 405 up to a predetermined end stop, and for the purpose of withstanding excessive axial stress, is safeguarded from slipping out by a circlip (not shown). At its inside diameter, armature disk 419 is supported on starter pinion 303 via a sliding disk 421. A circlip (not shown) is disposed here as well for the purpose of preventing loss, so that an unintentional decoupling of starter pinion 303 is advantageously avoided. Preferably, these axial retaining devices may also be implemented differently, but for reasons of space, should be as compact as possible.

The decoupling of the rotary motion of starter pinion 303 with respect to fixed armature 405 takes place preferably at the inside diameter, owing to sliding disk 421, and is therefore formed in especially low-wear fashion as an assembly.

Preferably, armature 405 is guided with the aid of a feather key (not shown) at the outside diameter, which in turn is preferably secured in intermediate bearing 331. For example, the anti-rotation element may also be implemented in another form using alignment pins and/or other standard elements and/or perhaps by design-engineering forms of armature 405 and/or intermediate bearing 331 and/or the coil housing.

Overrunning clutch 325, which, by preference, is implemented as meshing element on the standard generator or electric motor 305, is preferably axially non-moving, thus fixed, and is preferably part of the reduction gear or planetary gear 323, and in particular, is integrated in it. In particular, overrunning clutch 325 accommodates the axles of the planetary wheels (not shown) of planetary gear 323 and is integrated, for example, as an element of the planetary-gear carrier (not shown) in intermediate bearing 331. Intermediate bearing 331 also produces a support for rotor 313 of electric motor 305 and drive shaft 321 in the middle of starter 301.

Figure 5:
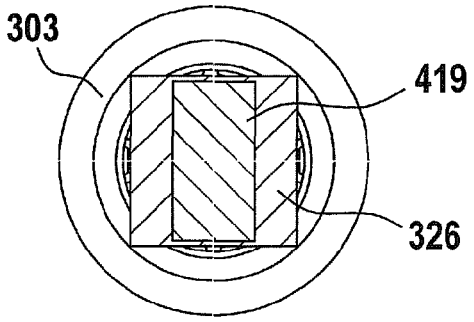
FIG. 5 shows an axial view of the starter pinion from FIG. 4.

FIG. 5 shows an axial view of starter pinion 303, engaging piece 419 and drive shaft 326 in the area of the toothing.

Figure 6:
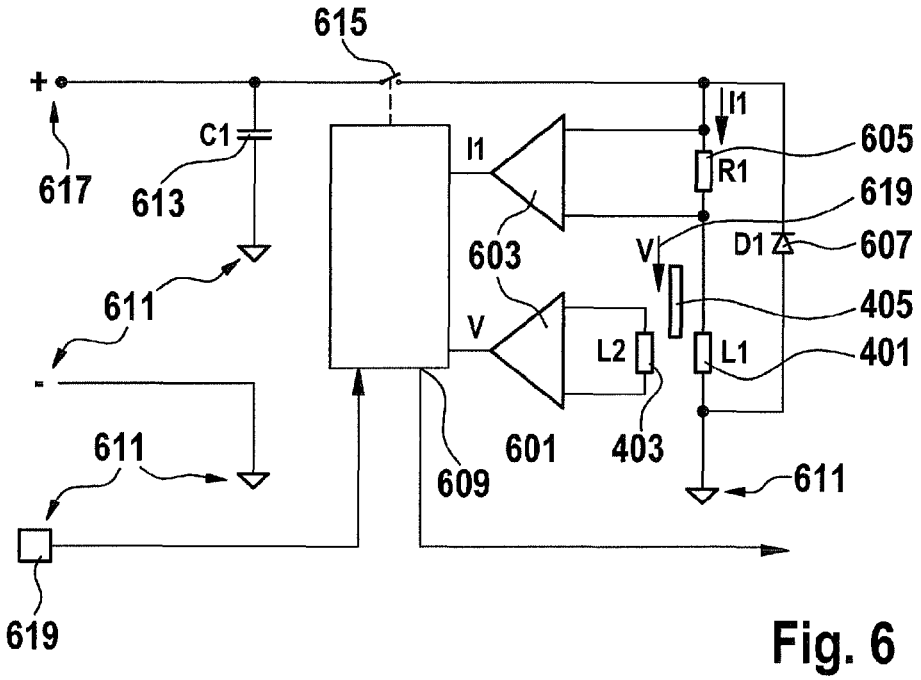
FIG. 6 shows an electrical layout of the starter from FIG. 3*a*.

FIG. 6 shows an electrical circuit plan of starter 301 from FIGS. 3*a* and 3*b*. A controller 601 regulates a coil current of primary coil 401 and of secondary coil, i.e., sensor coil 403, respectively, in each case, an amplifier 603 being connected between coils 401 and 403. A resistor 605 is inserted upstream of primary coil 401 for the purpose of limiting current. In addition, a diode 607 is inserted in the coil circuit of primary coil 401. The inductances of coils 401 and 403 are marked L1 and L2, respectively. Preferably, L1 and L2 are identical. For instance, L1 may also be greater than L2 and vice versa.

The controller has an interface 609 to electric motor 305, which may also be denoted as a starter motor. The elements having reference numerals 611 identify ground connections of the electrical starter system. The element having reference numeral 613 identifies a capacitor. A switch 615 opens or closes an electrical connection to a steady plus 617 of a starter battery (not shown). A starter signal to start electric motor 305 is supplied to controller 601 via a terminal 619.

The two coils 401 and 403 are energized with the aid of controller 601, a magnetic flux thereby building up which attracts armature 405 magnetically in the direction of the two coils 401 and 403. In this respect, armature 405 may also be denoted as a magnet armature. By preference, armature 405 is made of iron. Translatory motion v of armature 405 is identified by the arrow having reference numeral 619. This translatory motion v of the armature into the coil assemblage formed by the two coils 401 and 403 generates an induced voltage in coil 403, which is filtered out and made available to the control algorithm of controller 601. An advance of armature 405 is regulated as a function of the measured induced voltage, in particular by regulating a respective coil current accordingly.

Figure 7:
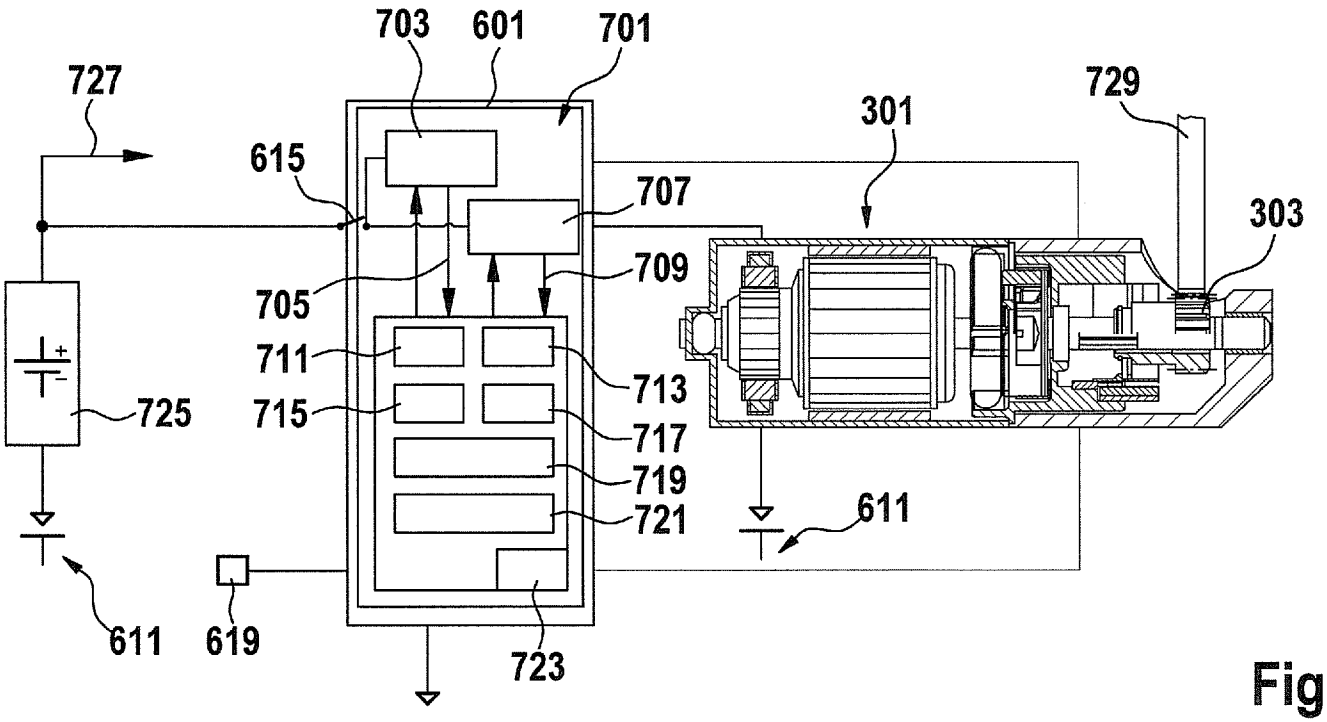
FIG. 7 shows a further view of the electrical layout from FIG. 6.

FIG. 7 shows a further view of the electrical circuit plan from FIG. 6. The controller is in the form of power electronics 701, and includes a meshing control 703 that, in particular, regulates a meshing current 705. Power electronics 701 further include a starter control 707 that, in particular, regulates a starter current 709. Power electronics 701 also include a meshing regulator 711, a starter regulator 713, a position detection 715, a phase detection 717, an operating system 719, a monitoring/diagnostic unit 721 and a sensor algorithm 723. Since, in particular, controller 601 is able to regulate an advance of starter pinion 303, controller 601 may also be denoted as an advance control.

The element having reference numeral 725 is a starter battery which is connected with its positive pole via switch 615 to controller 601. Starter battery 725 is connected to an electrical system (not shown) of the vehicle via a current line 727.

The element having reference numeral 729 identifies a starter ring gear that, in particular, includes a gear wheel disposed on a flywheel of an internal combustion engine (not shown). For the sake of clarity, not all reference numerals for the individual elements of starter 301 are marked in in FIG. 7.

Figure 8:
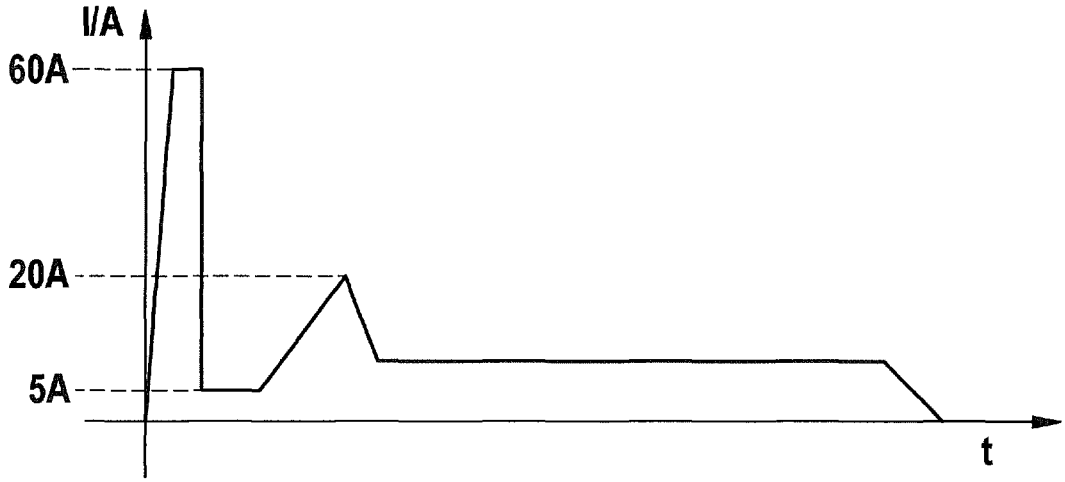
FIG. 8 shows a time characteristic of a meshing current.
Figure 9:
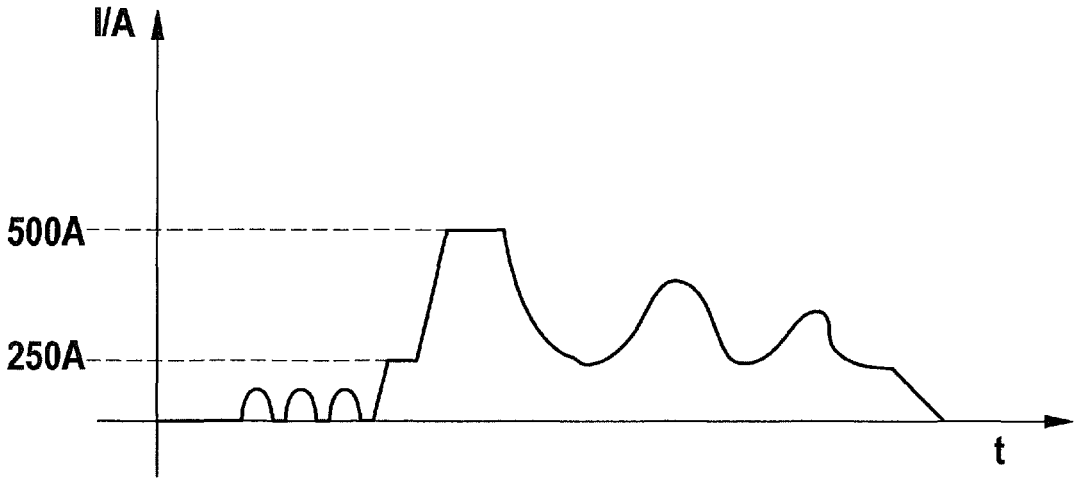
FIG. 9 shows a time characteristic of a starter current.

FIG. 8 and FIG. 9, respectively, show a time characteristic of the meshing current and of the starter current. Current I is plotted in amps against time t in arbitrary units.

Figure 10A:
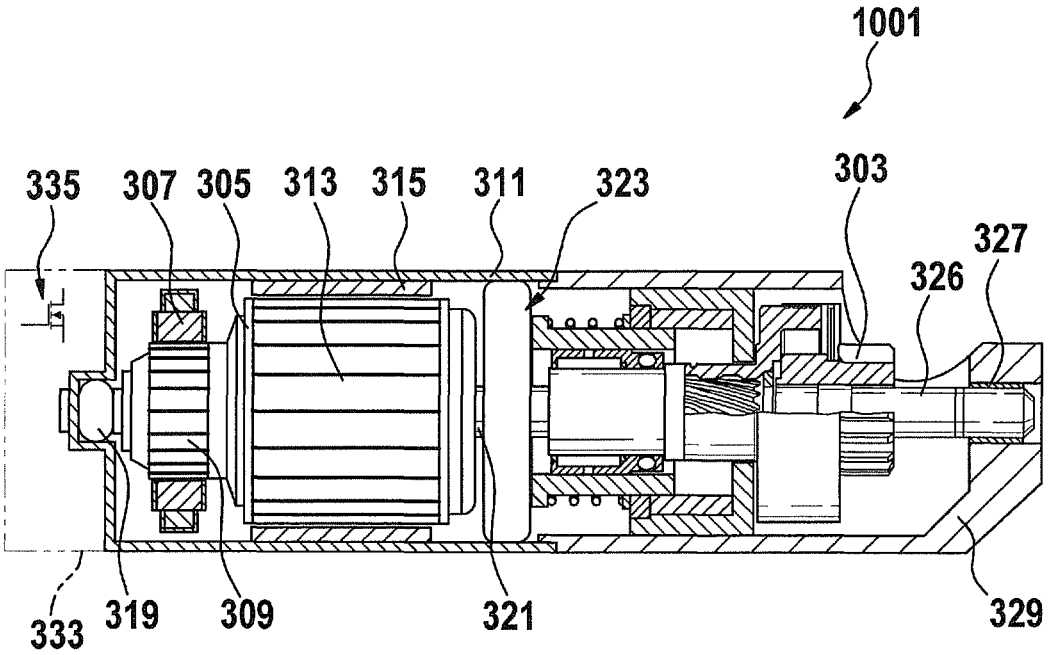
FIG. 10*a* shows a further starter with a non-engaged starter pinion.
Figure 10B:
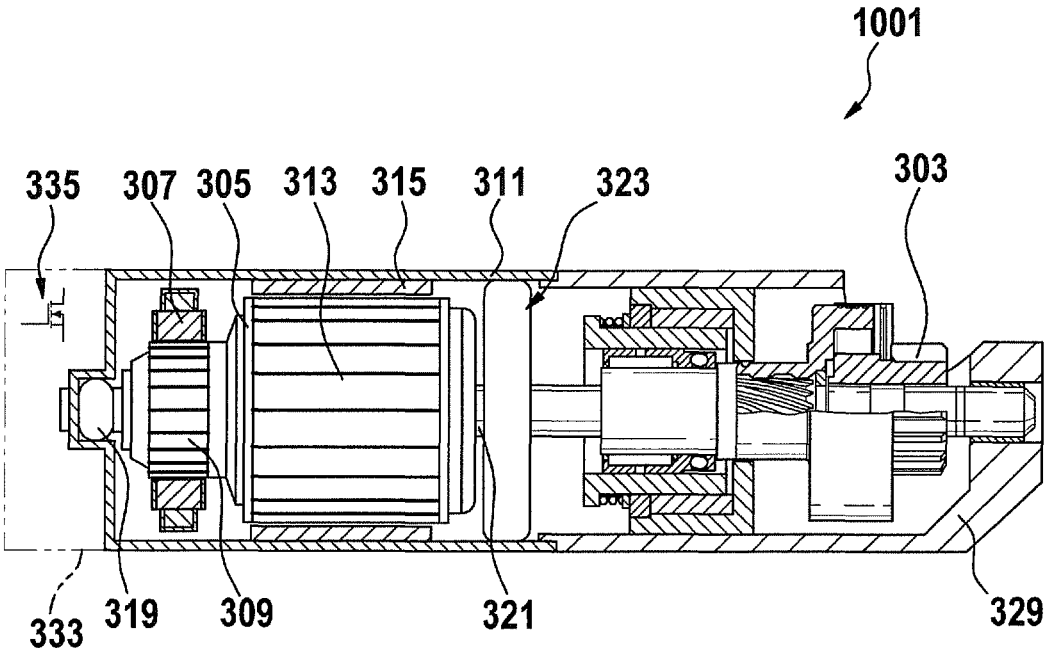
FIG. 10*b* shows the starter from FIG. 10*a* with an engaged starter pinion.

FIG. 10*a* and FIG. 10*b* show a further starter 1001, which is constructed similarly to starter 301. FIG. 10*a* shows starter 1001 with non-engaged starter pinion 303. FIG. 10*b* shows starter 1001 with engaged starter pinion 303. For the sake of clarity, the starter ring gear is not shown.

Figure 11:
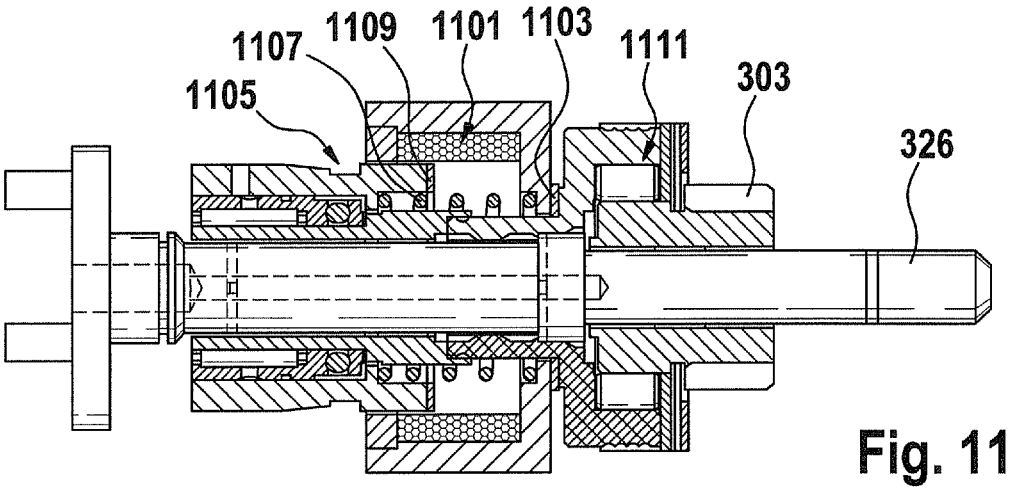
FIG. 11 shows an enlarged view of starter pinion from FIGS. 10*a* and 10*b*.

FIG. 11 shows an enlarged view of starter pinion 303 from FIGS. 10*a* and 10*b*. Power electronics, represented symbolically by transistor 335, energize a coil pack or coil assemblage 1101, which, analogous to FIG. 4, has a primary coil and a secondary coil (both not shown), a magnetic flux thereby being formed which brings about a mechanical force on armature 1103. In particular, a coupling between armature 1103 and starter pinion 303 may be analogous to the specific embodiment shown in FIG. 4. Starter pinion 303 is moved forwards, and due to the change in the magnetic circuit, an induced voltage is obtained on the secondary coil resulting from the movement and the change in current. The induced voltage of the movement is filtered out and made available to the control algorithm as a sensor signal for the speed of the meshing relay. Thus, the coil current may be regulated via the power electronics in such a way that a constant advance speed or regulated advance speed is obtained. Likewise, the position of starter pinion 303 may be inferred based on the integral of the speed, and possible mechanical impacts may advantageously be decreased.

In order to linearize the controlled system behavior, an air gap 1105 is formed which represents a function depending on the advance direction, so that advantageously, the control algorithm of the power electronics may be executed more easily.

Furthermore, a spring 1107 is formed, which resets starter pinion 303 after the starting process and retains the meshing mechanism with starter pinion 303 in a defined position of rest. In addition, an engaging piece 1109 is formed, which is constructed analogously to engaging piece 419, and produces the same technical effects.

Generally, a mechanical overrunning clutch 1111 may be formed both in the moving part and in the static part of the meshing mechanism.

Figure 12:
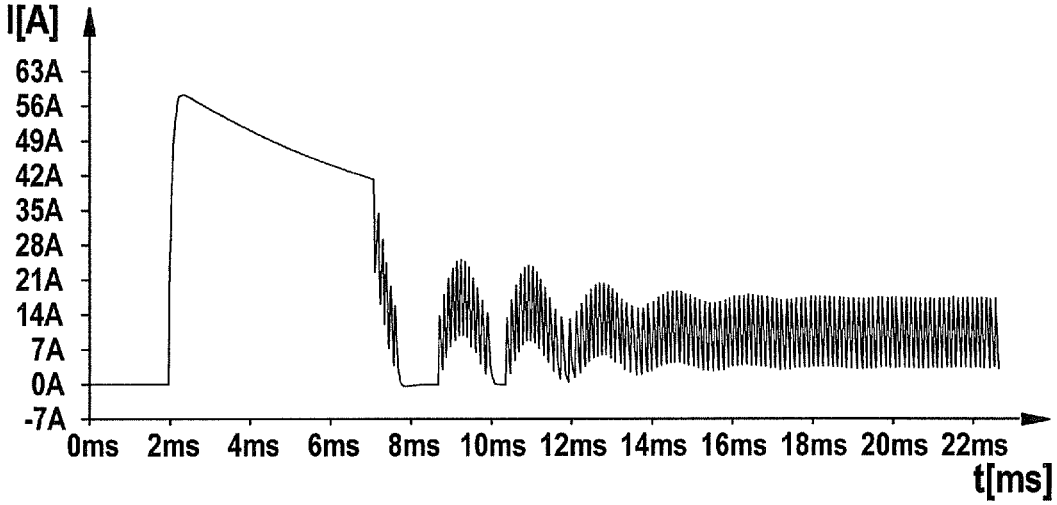
FIG. 12 shows a current characteristic of a primary coil over time.
Figure 13:
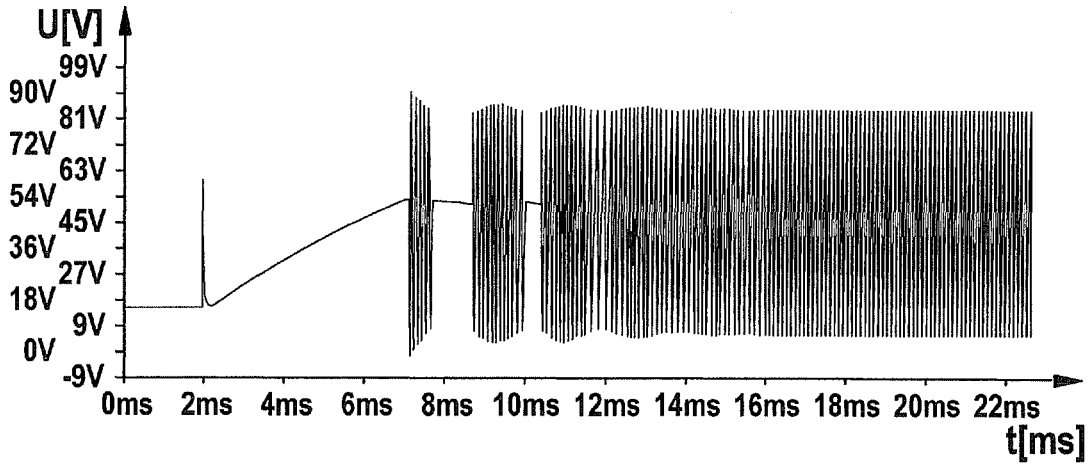
FIG. 13 shows an induced-voltage characteristic in a sensor coil over time.
Figure 14:
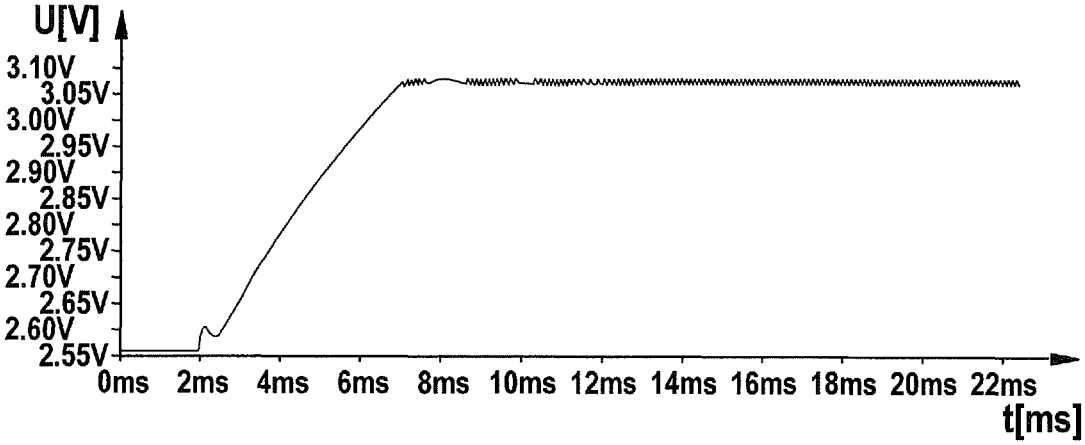
FIG. 14 shows a voltage characteristic of the starter-pinion movement over time.

FIG. 12, FIG. 13 and FIG. 14, respectively, show a time characteristic of the current in the primary coil, a time characteristic of the induced voltage in the sensor coil and a time characteristic of the filtered-out voltage of the movement. In FIG. 12, a current I is plotted in amps A against a time t in milliseconds ms. In FIGS. 13 and 14, in each case a voltage U is plotted in volts against a time t in ms. In all three figures, one can recognize a modulation in the curves depicted which results especially because rotation pulses act upon the starter pinion, that is, it is rotated pulse-by-pulse.

Figure 15:
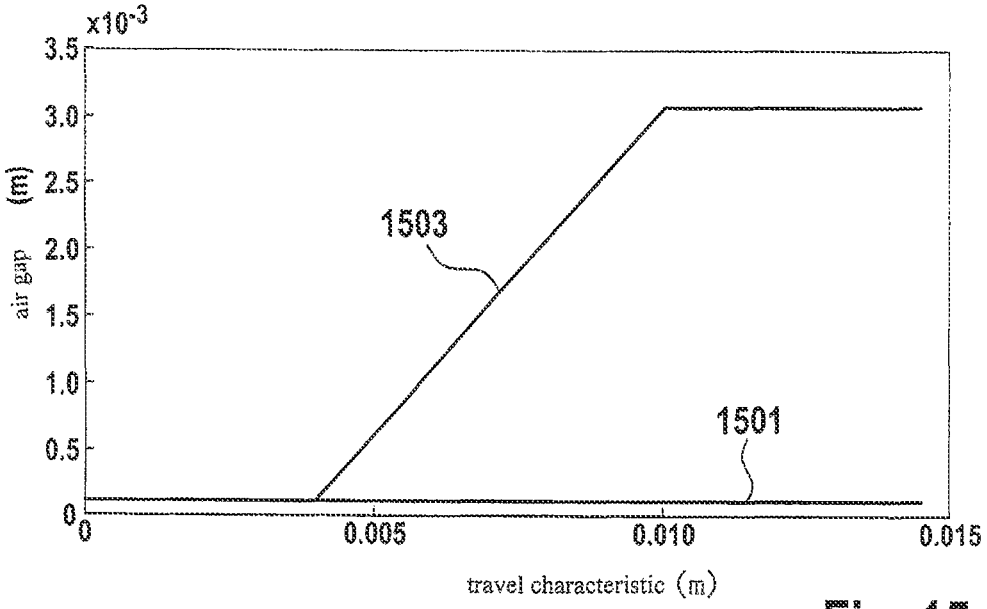
FIG. 15 shows an air-gap characteristic of a solenoid.

In the graph shown in FIG. 15, an air gap is plotted in meters m against a travel characteristic in meters m. The travel characteristic corresponds to the forward travel of the starter pinion. Thus, the air gap represents a function depending on the advance direction, which results in a linearization of the controlled system behavior. Reference numeral 1501 denotes a curve without a geometrical change, thus, without an air gap. The curve having reference numeral 1503 shows the characteristic with a geometrical change, thus, with an air gap.

Figure 16:
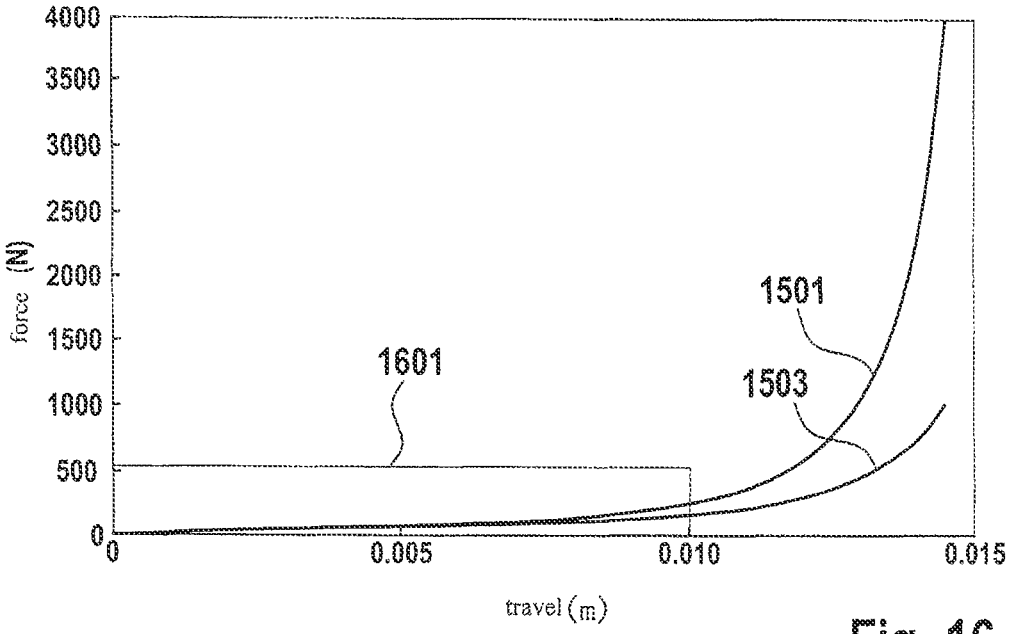
FIG. 16 shows a force characteristic of a solenoid.

FIG. 16 shows a force characteristic of a solenoid that is formed, in particular, by the primary coil and the secondary coil. The force which is generated by the solenoid is plotted in newtons N against a travel or travel characteristic in meters m.

Figure 17:
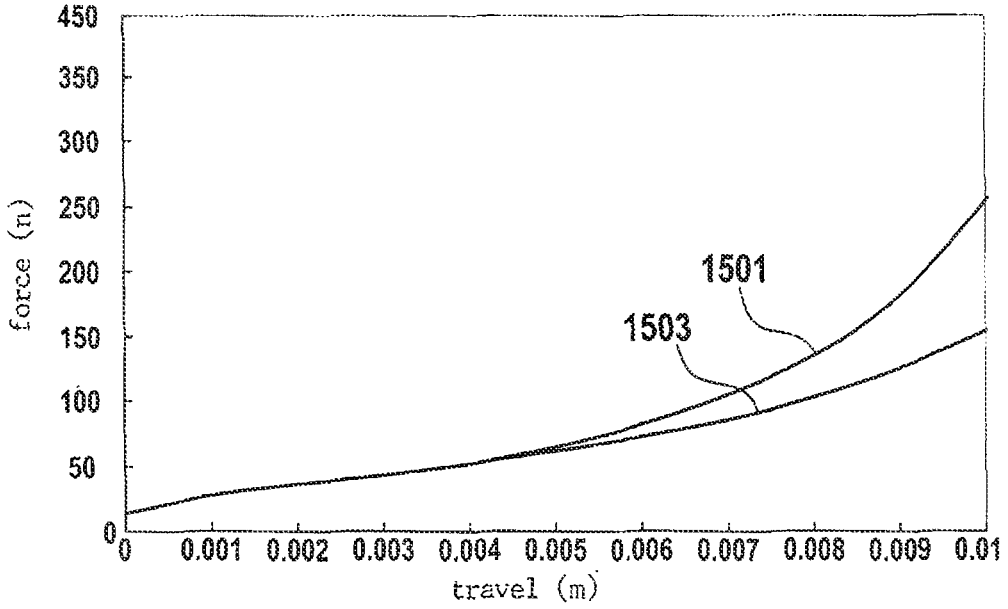
FIG. 17 shows an enlarged section of the force characteristic from FIG. 16.

FIG. 17 shows an enlarged view of section 1601 from FIG. 16.

With the aid of the present invention, the following functions, in particular, are made possible in the overall assembly made up of the starter and internal combustion engine.

Meshing into the Switched-Off Internal Combustion Engine

In the case of a stop function for start/stop vehicles, the starter pinion may already be meshed into the switched-off internal combustion engine, so that the starting time may be reduced by the period of time for the meshing process. Especially for reasons of comfort, this process is realized as quietly as possible and without great mechanical impacts. To this end, the pinion moves, preferably slowly, toward a possible tooth-on-tooth contact, while meantime, power electronics output rotation pulses to the starter motor. A tooth-on-tooth contact may be detected based on a speed signal of the meshing process, and the function of feeling between the teeth may be activated. This is accomplished with a combination of translatory and rotary movements of the starter pinion. When this state is overcome, the end position is then approached with a defined speed, and the holding current is reduced to a minimum. The period of time of the holding phase is a function, in particular, of the state of charge and a coil temperature. In any case, startability of the internal combustion engine must be ensured. The holding current is increased during the starting process, in order to ensure a reliable state of the pinion position. After the starting process has been carried out, the pinion is brought out of the toothing of the starter ring gear. This is realized by interrupting the magnetic circuit as well as via a return spring, especially spring 417, until the pinion is in the position of rest.

Quick Start

In the case of the first start or when working with a damaged battery, the meshing mechanism should only mesh as quickly as possible and start the internal combustion engine in response to the start command. To that end, the actuators, i.e., the primary and secondary coils, are fully energized, and rotation pulses are applied to the starter motor until the meshing mechanism has reached the end position. The meshing current is now brought to a holding level, and the starter motor is fully energized until the internal combustion engine has been started successfully. As described above, after the starting process has been carried out, the starter pinion is pushed out and brought into the position of rest via a return spring.

Meshing into the Coasting-Down Internal Combustion Engine

At the beginning of the stop phase, the internal combustion engine is switched off and coasts down due to its own inertia of mass. If there is a drop below the refiring limit and the internal combustion engine is to be started again as quickly as possible, it is necessary to mesh into the coasting-down internal combustion engine, and the internal combustion engine must be pulled along by the starter to rotational speed until it is able to resume operation independently.

In this case, the starter motor is accelerated with limitation of current and the meshing mechanism executes a feeling movement until the pinion engages in the starter ring gear. The starter is now in the overrunning phase, so that the starter current may now be increased, and the starter motor brings the internal combustion engine to the refiring speed again. As described, after the starting process has been carried out, the starter pinion is pushed out and brought into the position of rest via a return spring.

"Feeling" Function

The feeling function describes the interaction of the meshing mechanism and the starter motor during the engaging of the gear wheels upon meshing. In this context, the starter motor is driven in such a way that it generates rotational pulses at the starter shaft. Meanwhile, the meshing mechanism will effect a linear forward movement until there is contact of the starter pinion with the ring gear on the flywheel of the internal combustion engine. A tooth-on-tooth situation is detected, the meshing mechanism makes a small backwards movement, the starter receives a rotational pulse, and the meshing mechanism tries again to mesh using a changed pinion angle. This is carried out until the pinion is meshed without great expenditure of force.

What is claimed is:

1. A method for operating a starter of a motor vehicle, the method comprising:

providing a coil assemblage to build up a magnetic flux for an inductive advance of a starter pinion, wherein the coil assemblage has a sliding bushing configured to provide a displacement of an armature coupled to the starter pinion;

detecting a speed of advance of the starter pinion relative to a starter ring gear;

detecting a position of a starter pinion; and regulating an advance of the starter pinion as a function of the detected position and the detected speed of advance of the starter pinion relative to the starter ring gear;

wherein a meshing mechanism includes the coil assemblage, a sensor to detect the position of the starter pinion; and an advance control to regulate the advance of the starter pinion;

wherein the meshing mechanism is disposed concentrically around the starter pinion.

2. The method as recited in claim 1, wherein the detection of the position of the starter pinion includes detection of an induction change in response to the advance of the starter pinion.

3. The method as recited in claim 2, wherein the advance during the meshing of the starter pinion with a starter ring gear of a drive motor of the vehicle is regulated.

4. The method as recited in claim 3, wherein the starter pinion is rotated during the meshing, in order to feel into a space between two teeth of the starter ring gear.

5. The method as recited in claim 4, wherein the starter pinion is rotated pulse-by-pulse.

6. The method as recited in claim 1, wherein upon detecting a contact of a starter pinion tooth with a tooth of the starter ring gear, the starter pinion is moved in a direction counter to the direction of the advance, in order to create a distance between the starter pinion tooth and the tooth of the starter ring gear.

7. The method as recited in claim 6, wherein after the distance has been created, the starter pinion is rotated and moved in the direction of the starter ring gear in order to mesh with the starter ring gear.

8. A device for operating a starter of a vehicle, comprising:

a meshing mechanism, including:

a coil assemblage to build up a magnetic flux for an inductive advance of the starter pinion;

a sensor configured to detect a position of a starter pinion; and an advance control configured to regulate an advance of the starter pinion as a function of the detected position;

wherein the sensor has a sensor coil disposed in the coil assemblage for detecting an induction change in response to the advance of the starter pinion, and wherein the coil assemblage has a sliding bushing configured to provide a displacement of an armature coupled to the starter pinion, and wherein the meshing mechanism is disposed concentrically around the starter pinion.

9. The device as recited in claim 8, wherein the sliding bushing has at least one magnetizable ring for influencing the magnetic flux.

10. The device as recited in claim 9, wherein the at least one magnetizable ring is disposed one of displaceably or fixedly in the sliding bushing.

11. The device as recited in claim 8, wherein a spring is provided to retain the starter pinion in a position of rest, the spring being disposed in a drive shaft of the starter.

* * * * *